US005984194A

United States Patent [19]

Francalanci

[11] Patent Number: 5,984,194

[45] Date of Patent: Nov. 16, 1999

[54] VALVE FOR CONTROLLING THE TEMPERATURE OF THE WATER IN A WASHING MACHINE OR DISHWASHER, METHODS OF TREATING WATER IN THESE MACHINES WHICH CAN BE IMPLEMENTED BY MEANS OF SAID VALVE AND MACHINES FOR WASHING USING THIS VALVE

[75] Inventor: Stefano Francalanci, Varese, Italy

[73] Assignee: T & P S.p.A., Varese, Italy

[21] Appl. No.: 08/951,305

[22] Filed: Oct. 16, 1997

[30] Foreign Application Priority Data

Feb. 18, 1997 [IT] Italy ..... MI97A0345

[51] Int. Cl.[6] ..... G05D 23/13

[52] U.S. Cl. ..... 236/12.12; 236/93 K

[58] Field of Search ..... 236/12.12, 93 R, 236/93 B

[56] References Cited

U.S. PATENT DOCUMENTS

| | | | |
|---|---|---|---|
| 4,657,038 | 4/1987 | Lyons | 236/93 R |
| 4,909,435 | 3/1990 | Kidouchi et al. | 236/93 R |
| 4,923,116 | 5/1990 | Homan | 236/12.12 |
| 4,941,608 | 7/1990 | Shimizu et al. | 236/12.12 |
| 5,033,671 | 7/1991 | Shiba et al. | 236/12.12 |
| 5,255,844 | 10/1993 | Miller et al. | 236/12.12 |
| 5,358,177 | 10/1994 | Cashmore | 236/93 R |
| 5,439,019 | 8/1995 | Quandt et al. | 236/12.12 |
| 5,511,723 | 4/1996 | Toshio et al. | 236/12.12 |

*Primary Examiner*—William E. Tapolcai
*Attorney, Agent, or Firm*—Young & Thompson

[57] ABSTRACT

A valve for use in machines for washing, such as washing machines for laundry, dishwashers and the like, includes a hollow valve body wherein a current of water flows, entering the valve body via at least one inlet of the valve, and at least one plug element for allowing and, respectively, preventing the outflow of water from a corresponding outlet of the valve. The valve is connected to at least one temperature sensor device having a first and a second working state corresponding to an open and closed condition of an electrical connection and in that the sensor device has a preset trigger temperature which, when reached, causes the change from a state of closure to one of opening of the connection or vice versa. Methods of treating the water in these machines for washing also can be implemented with the valve and machines for washing using this valve.

26 Claims, 3 Drawing Sheets

VALVE FOR CONTROLLING THE TEMPERATURE OF THE WATER IN A WASHING MACHINE OR DISHWASHER, METHODS OF TREATING WATER IN THESE MACHINES WHICH CAN BE IMPLEMENTED BY MEANS OF SAID VALVE AND MACHINES FOR WASHING USING THIS VALVE

FIELD OF THE INVENTION

The present invention relates to the field of machines for washing such as washing machines for laundry, dishwashers and the like.

BACKGROUND OF THE INVENTION

The invention relates more particularly to a valve which is especially suitable for controlling the temperature of the water and which can be used in these washing machines, dishwashers and the like.

The valve structure of the present invention also allows the provision of various advantageous methods of controlling the temperature of the water in said machines for washing. These advantageous methods of controlling the water temperature are also the object of the present invention.

The invention finally relates to machines for washing of the type mentioned above which allow implementation of the aforementioned methods using the valve of the invention.

Machines for washing are currently known, be they washing machines for washing home laundry or dishwashers for washing dishes in general, which, briefly, comprise a drum for washing the articles, a circuit for supplying the washing water to said drum, valve means for supplying hot water and cold water in said circuit of the current of water for said drum for washing the articles and a suitable timer for controlling operation of the machine.

More particularly, in the case of washing machines for laundry, the additional provision of at least one compartment for holding detergent is also made, wherein a current of water is made to flow which removes the detergent and transports it into the washing drum, and suitable valve means for supplying a flow for removing the detergent in said compartment for the detergent.

These known machines for washing are advantageous in that they allow exploitation of the hot water already supplied in the home, where it is produced by suitable boilers or water heaters in general by means of gas burners or the like, which, by mixing this hot water with the cold water coming from the water supply system, provide the washing drum with already heated water which must not be or must be only partially heated, by means of the electrical resistor of the drum. This smaller use of the resistor for heating the drum water allows considerable savings in relation to a lower consumption of energy and above all enables the machines to be fitted with smaller-sized resistors with a saving in costs and in the material used.

A disadvantage noted in this area relates to the fact that, in the places where these machines are installed, the temperatures of the cold water and possibly also of the hot water can differ considerably from one place to another, and it is not therefore possible to program a preset time cycle for feeding the various flows of hot and cold water which is effective for all environmental situations.

Currently the timer for controlling operation of the washing machine is subjected to signals of the temperature of the washing water which are late, that is to say they are only triggered after the washing drum has been filled completely with washing water and therefore nothing else can be done but actuate heavily the resistor for heating the drum water, with a serious waste of energy.

Such a negative fact occurs frequently when the source of hot water fed to the drum is too far away, so that when such water is fed to the drum in actual fact the cold water contained in the pipes connected to the source of heated water is fed. As a result equally cold water is added to the cold main water with the consequences related above.

SUMMARY OF THE INVENTION

In order to avoid the disadvantages related above, according to the present invention a valve structure has been developed having the features of claim 1.

With the use of such a valve of the invention it is therefore possible to sense the temperature of the water very soon, before this water enters the drum, and it is possible to actuate the valves upstream promptly and rapidly to control the flows of water fed into the machine for washing.

The open or closed signal emitted by the sensor device of the valve can immediately be used to perform a command operation without any need for this signal to undergo various amplification and processing operations which make it suitable for use, the whole in view of an extremely rapid and effective trigger response.

The invention also relates to methods of controlling the temperature of the water in said machines for washing, which can be advantageously implemented by the use of the valve of the present invention and form the object of claims 19 to 21, as well as machines for washing which are the object of claims 24 to 25 and which implement the aforementioned methods by using the valve of the invention.

Further advantageous features of the invention are the object of secondary claims.

BRIEF DESCRIPTION OF DRAWINGS

Additional features and advantages of the present invention will in any case be made clearer on reading the following description, relating to preferred embodiments of the invention, to be read with reference to the accompanying drawings, wherein.

DESCRIPTION OF PREFERRED EMBODIMENTS OF THE INVENTION

Figure 1:
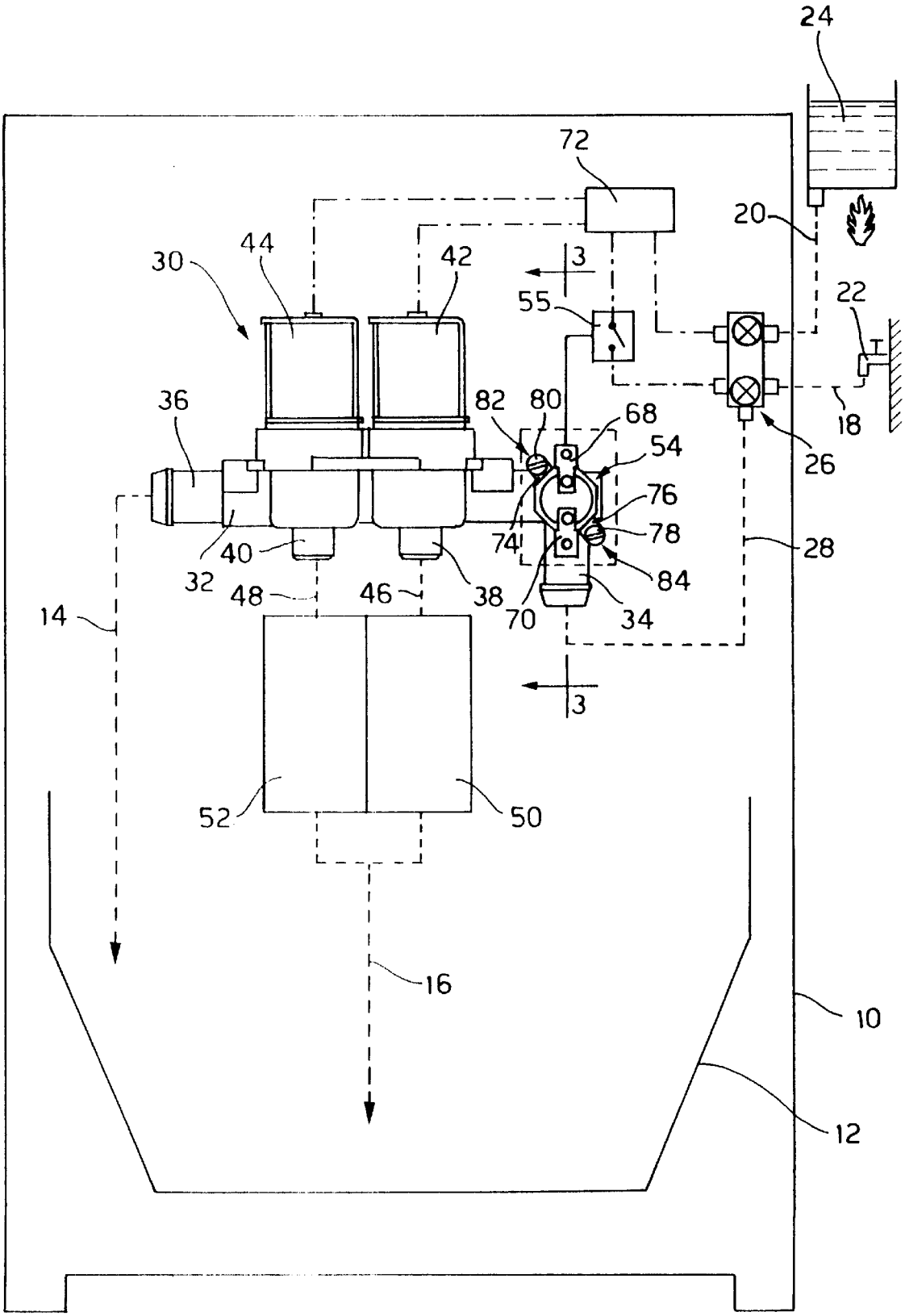
FIG. 1 illustrates a schematic view of the washing machine using the valve with thermostat according to a first preferred embodiment of the present invention; in this illustration the valve is shown as viewed from above.

FIG. 1 illustrates extremely schematically the structure of a machine for washing 10, more particularly a washing machine for laundry, having a drum 12 for washing articles of clothing and the like wherein two flows of water 14 and 16 respectively are fed, whereof the flow of water 14 forms the true flow for filling the drum, while the flow 16 defines a diverted flow of water which carries the detergent to the washing drum.

According to this first embodiment shown, the water for feeding the drum 12 of the washing machine is obtained from the mixture of two different flows 18, 20, coming from the water supply system 22 and from a source of heated water 24 respectively, such as for example a centralised boiler, water heater or the like.

The cold water 18 and heated water 20 are then mixed inside a mixing valve 26 connected by means of a conduit 28 to the valve according to the first preferred embodiment of the present invention. It must however be understood that the feeding of hot and cold water into the circuit for conveying the water of the washing machine could also be performed via feed valves separate and distinct one from the other, and not via the mixer mentioned, without this involving a departure from the concept claimed.

Figure 2:
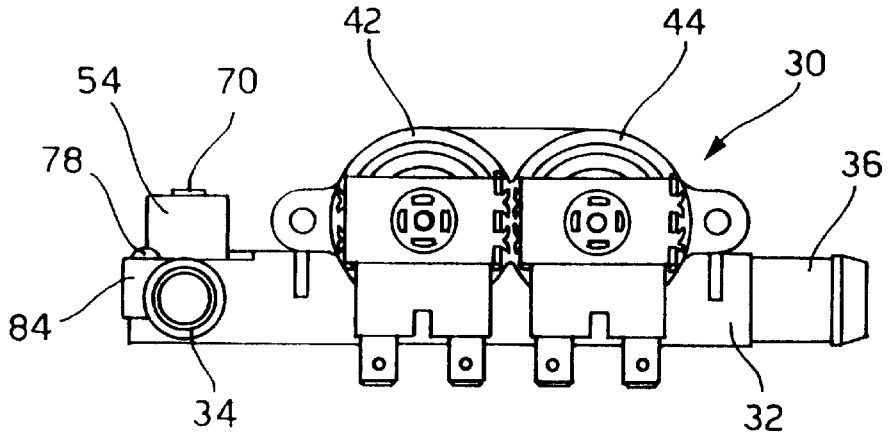
FIG. 2 represents a side elevation view of the valve according to the preferred embodiment of FIG. 1.
Figure 3:
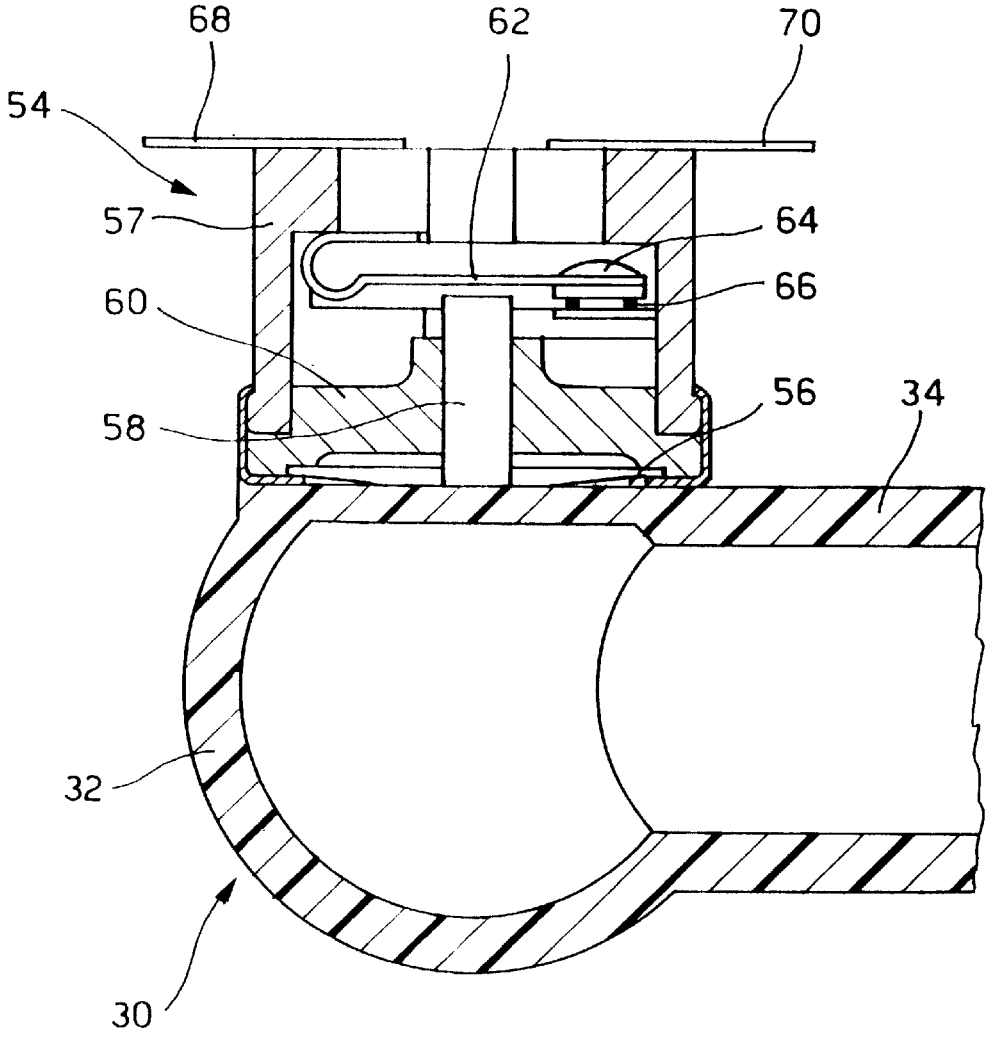
FIG. 3 is a sectioned view taken along line 3—3 of FIG. 1.

With reference also to the subsequent FIGS. 2 and 3, it can be seen how the valve 30, according to the first embodiment of the invention, comprises a hollow valve body 32, wherein the current of water flows, entering the valve body via an inlet 34 of the valve, an outlet 36 placed coaxially to the valve body 32 on the opposite side of said inlet 34, and a first and a second diverted outlet 38 and 40 respectively which extend from said hollow valve body 32 orthogonally to the latter and which are connected to corresponding plugs (not shown in the figures), commanded by respective coils 42, 44, and are suitable for conveying respective diverted flows of water 46, 48 towards corresponding compartments 50, 52 for housing a respective detergent, conditioner or other product to be sent via the conduit 16 to the washing drum.

The valve of the present invention can be connected in a preferred manner directly to a corresponding drawer for detergents according to the teachings described in the European patent EP-A-0 688 895 owned by the applicant, as also connected to the drawer, in a more traditional manner, by means of hoses and attachment clamps.

The valve of the present invention has been provided with a section for measuring the temperature of the water which flows inside the valve body and for actuation of a suitable phase of control of this temperature.

According to the invention provision is made for said valve to be connected to at least one first temperature sensor device 54, which has a first and a second working state corresponding to a condition of opening and closure of an electrical connection. The sensor device also has a preset trigger temperature which, when reached, causes the change from a state of closure to one of opening of the connection or vice versa.

The fact of connecting said sensor device for the temperature of the washing water to the valve, situated on the path which takes said water to said drum, allows the temperature of the washing liquid to be sensed well before the latter has reached said drum. If this temperature of the water does not therefore fulfil the needs of the type of washing underway, it is thus possible to intervene in good time before said water reaches the drum of the machine for washing.

Moreover, the fact that the sensor device enables or disables an electrical connection on reaching a preset trigger temperature is a further guarantee of prompt intervention; the open and closed signal is immediately available to the timer or for direct control of a solenoid valve and does not need further various amplification and processing operations on the signal which could delay considerably the response times of the system.

In this way the quantity of water having an undesirable temperature which enters the drum is reduced.

In a preferred manner provision has been made for connecting to said valve a thermostat 54, which is rested on the external surface of the same valve with its sensitive bimetallic disk 56. This solution enables direct contact of the sensing element with the liquid, whose temperature must be high, to be avoided. It is not therefore necessary to provide openings for inserting the temperature sensitive element in the valve body and therefore all those problems and costs linked to providing holes in the valve body are eliminated, as well as provision of the relevant seals and the risks of leaks inherent therein.

The thermostat also comprises, inside a case 57, in a manner moreover known, a transmission peg 58, connected to said bimetallic disk 56 and carried, axially slidingly, by a portion of base 60 of the thermostat, whose peg 58 engages on an elastic plate 62 supporting at its end a mobile contact 64 suitable for engaging and disengaging with a respective fixed contact 66 for the opening and closure respectively of an electrical circuit for controlling the temperature of the water.

The bimetallic disk 56, on reaching the trigger temperature, trips and closes the electrical contact. Obviously it would also be possible to arrange the bimetallic disk in such a way that it trips and opens said contact of the thermostat.

As shown in the figures, the thermostat 54 therefore has two connection pins 68, 70 for the electrical connection of the same to the electrical circuit of a special section 72 for commanding the washing machine, which can be irrespectively in the form of an electromechanical timer or a more sophisticated electronic timer, in any case, as will be explained further hereinunder, the device of the present invention is advantageous if it co-operates with the more traditional electromechanical timers, in that it enables the setting-up of complex control procedures in said timers to be eliminated.

According to a further advantageous feature of the present invention, in order to allow a better perception of the temperature of the fluid which flows inside the valve 30, generally made in a plastic material, the external wall of the same has been thinned and a flat-shaped base formed for a stable support for the sensitive bimetallic disk of said thermostat.

Provision has also been made for positioning said thermostat at a point wherein the water which flows inside the same valve decelerates in order to have an even more effective perception of the temperature of the water inside the valve. More particularly, according to the first preferred embodiment shown, said thermostat 54 is positioned at a curved section of the valve, that is to say at the point of the entrance in the valve body of the inlet 34, which is positioned orthogonally in relation to the axis of the valve body 32.

In a preferred manner, said thermostat is connected to said valve by means for removable attachment, which means comprise perforated tongues 74, 76 integral with the body of the thermostat 54 and attachment screws 78, 80 suitable for screwing into special holes provided in portions 82, 84 projecting laterally to said valve body. More particularly, according to the embodiment shown, said projecting portions 82, 84 for inserting the attachment screws are made in the form of substantially cylindrical projections aligned one with the other along an oblique line in relation to the axis of the valve body.

With the use of the valve described above it is also possible to implement a method for feeding washing water inside a machine for washing, such as a washing machine for laundry, wherein the supply of cold water is delayed until the hot water has reached a preset working temperature.

In general, according to the prior art, the cycle of feeding water into the machine lasts around 1 minute and the timer is programmed to open the cold water feed valve 30 seconds after opening of the hot water valve. As already mentioned, however, if the source of hot water is far away, or, due to other negative causes, the hot waterwhich enters the machine has not yet reached the required temperature, it is possible, on indication of the thermostat 54, not to allow opening of the plug of the valve for cold water, which will instead only be fed when the temperature sensed by the thermostat is the one required, that is to say equal to the trigger temperature for which the thermostat has been calibrated.

For this purpose, as shown in FIG. 1, the switch 55 of the thermostat 54 is inserted in the electrical circuit for actuation of the valves for feeding cold water 18 between the machine control timer 72 and the cold water valve itself.

As shown, the switch or contact of the thermostat is normally kept open and inhibits the use of the solenoid valve which allows the feed of cold water. Only when the temperature of the water measured by the thermostat reaches the preset trigger value does the bimetallic strip of the thermostat cause the closure of the contact and allow actuation of the solenoid valve for the water and the feed of said cold water.

According to a further working possibility of the system, it is possible to send the signal emitted by the closure or opening of the contact of the thermostat directly to the timer (not shown in the figures) which will deal with it as appropriate in order to launch predetermined procedures of command of the various solenoid valves, to allow feeding only of sufficiently hot water in the hydraulic circuit of the machine forwashing.

Thanks to the valve of the present invention, following perception by the timer of the reaching of the trigger temperature of the timer, predetermined procedures can be launched which command opening of the plug of the valve 30 to allow water to be fed into the diverted conduit of the compartment of the detergent in order to supply the water for removing the detergent from said compartment. In this way, in said detergent compartment, heated water is only fed when the latter has a temperature higher than a minimum preset temperature. This allows provision in the detergent compartment of only water which has a suitable temperature for obtaining optimum removal or extraction of the detergent and/or washing additives from the detergent compartment. The compartment for the detergent therefore remains cleaner in relation to what can be obtained by the known art, and no problem is caused through the need for periodical cleaning of the detergent compartment and nor is there any risk of hygiene problems arising due to remains of detergent left in the compartment for a long time.

Figure 4:
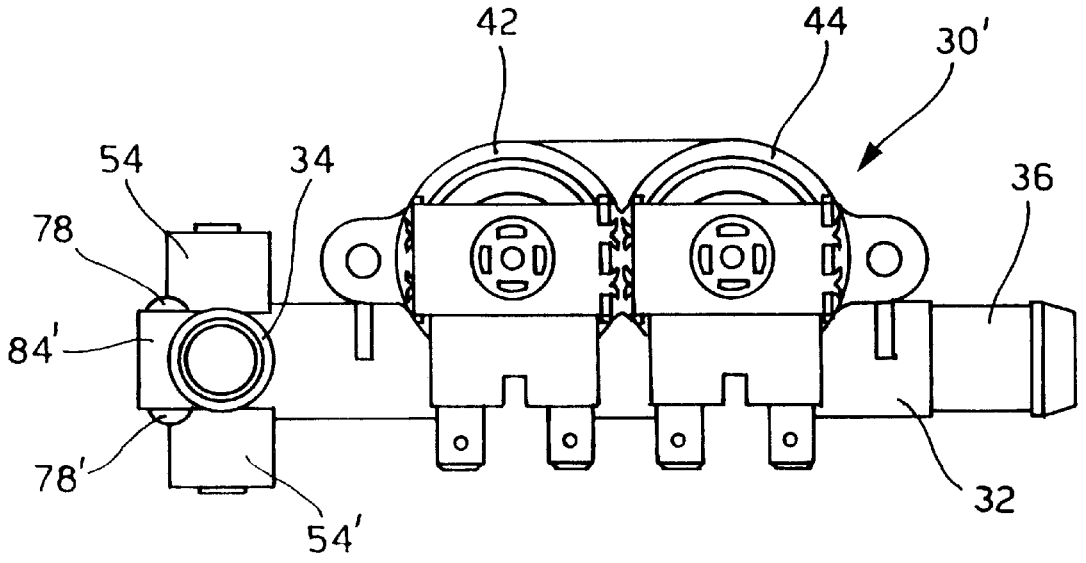
FIG. 4 is a side view of a second preferred embodiment of the invention.

FIG. 4 illustrates a second preferred embodiment of a valve according to the present innovative concept. This second valve embodiment 30' is wholly similar to the first embodiment wherefrom it departs due to the fact that it has, in addition to a first, also a second temperature sensor device 54', also having a first and a second working state corresponding to a condition of opening and closure of an electrical connection. Said second sensor device 54' has a preset trigger temperature and, having reached it, causes the change from a state of closure to one of opening of the connection or vice versa.

Preferably said first and second sensor devices 54 and 54' have different trigger temperatures, wherein the first sensor device 54 is set at a minimum temperature of feeding the water into the machine which could for example be 40° C., in order not to feed water which is too cold as described previously with reference to the first valve embodiment, while the second sensor device 54' is in turn set at a maximum temperature of feeding water into the drum, which could for example be 70° C., used in turn to prevent discharging into the drum of water which is too hot and which could damage delicate garments, such as for example those in silk.

The valve 30' of this second embodiment is therefore such as to allow passage only of water which has a temperature between the limit temperatures set for triggering of said first and second sensor devices.

In this valve of this second embodiment the temperature sensor devices are both in the form of a thermostat, such as in the first embodiment, and both are fitted on the valve in a manner wholly similar to what is provided in the previous embodiment. It is not therefore necessary to give any specific description for all these features of application, positioning, attachment and others. The components of this second valve, which are similar to those of the first valve, therefore also maintain the same reference numerals as those of the first embodiment.

Therefore for this second valve embodiment only those which are the structural and functional differences compared to said first valve embodiment 30 are pointed out.

In relation to FIG. 4, it can therefore be seen that the valve 30' of the second embodiment has said first and second sensor devices or thermostats 54 and 54' which are connected to the valve on opposite sides of the same valve 30'. This arrangement allows a considerable saving in space for the valve.

Moreover the temperature sensor devices, or thermostats, 54 and 54' are attached to the same portions projecting laterally to said valve body, of which only 84' is shown in FIG. 4. Unlike what is shown with reference to the first preferred embodiment, said projecting attachment portions, although retaining the shape and arrangement of the first valve embodiment, now have holes on both sides for inserting screws 78 and 78' for attaching both thermostats 54 and 54'.

Although not shown in the figures, the valve 30' of this second preferred valve embodiment is preferably used in a machine for washing such as a washing machine for laundry wherein said first and second temperature sensor devices of the valve are both connected to the control timer of the machine in order to supply the latter with a signal indicating the reaching of one or the other set working temperatures of the sensing element.

Thanks to this type of valve with two sensors it is therefore possible to implement a method of feeding water to the washing drum, and also to the detergent drawer, whereby the temperature of the water fed into the circuit for feeding water to the washing drum is sensed and the valve means for feeding a current of water into said drum for washing articles is controlled, in such a way that, if the temperature drops below a minimum preset temperature, the entrance of cold water is blocked or the entrance of hot water is enabled, and if the temperature of the water is above a maximum preset temperature the entrance of cold water is enabled or the entrance of hot water blocked.

Broadly speaking a water feeding method is provided such as to have only one temperature between a minimum preset temperature and a maximum preset temperature.

Figure 5:
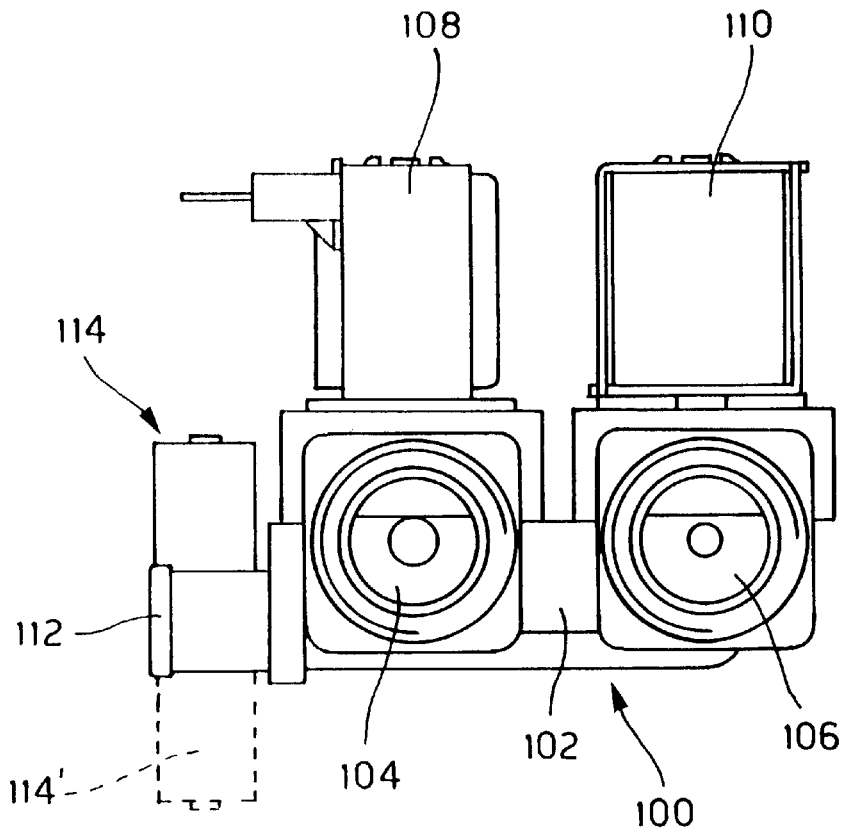
FIG. 5 is a side elevation view of a third preferred embodiment of the valve with thermostat of the present invention.

FIG. 5 illustrates a third embodiment of the valve according to the present invention.

In this case it is a valve of the mixing type 100 comprising a valve body 102 wherein the hot and cold water is mixed and wherein a first inlet 104, having a respective opening and closure plug to allow feeding of cold water, and a second inlet 106, the latter also connected to a respective opening-closure plug and intended to feed hot water into the mixer body, flow respectively.

The respective plugs are actuated by corresponding actuation coils 108, 110.

The inlets 104, 106 are arranged orthogonally to the hollow valve body 102, axially whereto an outlet 112 extends and at which a thermostat 114 is mounted and which substantially has the same features of the thermostat relating to the first valve embodiment and which does not therefore have to be commented on again in detail.

Moreover, although not shown, it would also be possible to mount the thermostat directly on the valve body, upstream of the outlet and downstream of the two hot and cold water inlets.

Unlike the first embodiment, in this third one the thermostat 114 is no longer mounted at a curved section of the valve, however in this third embodiment there is the same thinning of the external wall of the valve, as well as the fact that means of attachment substantially similar to those shown previously are provided.

The internal features of the thermostats 114 and 54 are wholly similar one to the other.

Obviously it would also be possible to mount on this mixing valve, on the side opposite to the one whereon the thermostat 114 is mounted, a second thermostat 114', in a manner wholly similar to what is described for the second preferred embodiment of the invention.

The thermostat or thermostats of this third valve embodiment can be connected to the command circuit of the machine for washing according to any one of the ways described previously in relation to the two previous valve embodiments.

The two versions, with one or two thermostats, of this third preferred valve embodiment, can be mounted either on dishwashers or on washing machines which do not provide for the removal or detergent or additive by means of a current of water via the compartment housing the same, and also on washing machines provided with such a method of removing detergent.

Obviously it could also be foreseen, in the valves described and having one single thermostat, to use a single thermostat set to the maximum working temperature of the machine for washing instead of the minimum temperature as stated hitherto.

It must obviously be understood that what has been written and shown with reference to the preferred embodiments of this invention has been given purely by way of a non-limiting example of the principle claimed.

What is claimed is:

1. A valve which can preferably be used in machines for washing, such as washing machines for laundry, dishwashers and the like, of the type comprising a hollow valve body wherein a current of water flows, entering the valve body via at least one inlet of the valve, and at least one plug element for allowing and respectively preventing the outflow of water from a corresponding outlet of the valve; said valve being connected to at least one first temperature sensor device having a first and a second working state corresponding to a condition of opening and closure of an electrical connection and in that said sensor device has a preset trigger temperature which, when reached, causes the change from a state of closure to one of opening of the connection or vice versa; and a second temperature sensor device having a first and a second working state corresponding to a condition of opening and closure of an electrical connection and in that said sensor device has a preset trigger temperature which, when reached, causes the change from a state of closure to one of opening of the connection or vice versa, wherein said first sensor device and second sensor device have different trigger temperatures.

2. A valve according to claim 1, wherein the temperature sensor device or temperature sensor devices is or are in the form of a thermostat.

3. A valve according to claim 1, wherein the temperature sensor device, in order to sense the temperature of the water in the valve is rested on the external surface of the valve itself.

4. A valve according to claim 3, wherein the temperature sensor device, or thermostat, or the temperature sensor devices, or thermostats, in order to sense the temperature of the water in the valve is connected, or are connected, to the valve at the point wherein the water which flows inside the valve itself decelerates.

5. A valve according to claim 4, wherein said temperature sensor device, or thermostat, or temperature sensor devices, or thermostats, is positioned, or are positioned, at a curved section of the valve.

6. A valve which can preferably be used in machines for washing, such as washing machines for laundry, dishwashers and the like, of the type comprising a hollow valve body wherein a current of water flows, entering the valve body via at least one inlet of the valve, and at least one plug element for allowing and respectively preventing the outflow of water from a corresponding outlet of the valve; said valve being connected to at least one first temperature sensor device having a first and a second working state corresponding to a condition of opening and closure of an electrical connection and in that said sensor device has a preset trigger temperature which, when reached, causes the change from a state of closure to one of opening of the connection or vice versa, wherein for a resting of said temperature sensor device, or thermostat, or of said temperature sensor devices, or thermostats, at the point of application said valve has a respective thinning of the external valve wall.

7. A valve according to claim 6, wherein for the resting or said temperature sensor device, or thermostat, or said temperature sensor devices, or thermostats, a flat support surface is formed in the valve body.

8. A valve according to claim 6, wherein the temperature sensor device, or thermostat, or temperature sensor devices, or thermostats, is connected, or are connected, to said valve via means for removable attachment.

9. A valve according to claim 8, wherein said means for removable attachment are in the form of perforated tongues integral with said temperature sensor device, or thermostat, or with said temperature sensor devices, or thermostats, and comprise attachment screws for screwing in special holes provided in the valve.

10. A valve according to claim 9, wherein said attachment holes are provided in portions projecting laterally to said valve body.

11. A valve according to claim 10, wherein sed in that said projecting portions for insertion of the screws for attaching the thermostat are provided on an oblique line in relation to the axis of the valve body.

12. A valve according to claim 1, wherein said first and second sensor elements or thermostats are connected to the valve on opposite sides of the valve.

13. A valve according to claim 12, wherein the temperature sensor devices, or thermostats, are attached to the same portions projecting laterally to said valve body, these portions having holes on both sides for attachment of both the sensor devices.

14. A valve according to claim 1, wherein in said valve said outlet is positioned orthogonally in relation to the axis of the valve body to feed a diverted flow of water towards a detergent compartment and wherein said valve has a main outlet axial to the axis of said valve body and suitable for feeding water to a washing drum of the machine.

15. A valve according to claim 14, wherein said valve has an inlet in the valve body positioned orthogonally in relation to the axis of the valve body, and in that said temperature sensor device, or thermostat, or temperature sensor devices, or thermostats, is mounted, or are mounted, on the valve body at the entrance in the valve body of said inlet.

16. A valve according to claim 1, more particularly a mixing valve of the type comprising a valve body connected to a first inlet and having an opening and closure plug and a second inlet having a respective opening and closure plug and having an outlet, wherein the temperature sensor device, or thermostat, or the temperature sensor devices, or thermostats, is mounted, or are mounted, on said valve body or on said outlet.

17. A method for feeding washing water into a machine for washing such as a washing machine for laundry, dishwasher and the like, wherein the machine for washing comprises a drum for washing articles, a circuit for feeding washing water to said drum, valve means comprising a hollow valve body wherein a current of water flows, entering the valve body via at least one inlet of the valve, and at least one plug element for allowing and respectively preventing the outflow of water from a corresponding outlet of the valve, said valve being connected to at least one first temperature sensor device having a first and a second working state corresponding to a condition of opening and closure of an electrical connection and in that said sensor device has a preset trigger temperature which, when reached, causes the change from a state of closure to one of opening of the connection or vice versa for feeding cold water and hot water in said circuit of the current of water for said drum for washing articles, and a suitable timer for controlling operation of the machine, comprising the step of delaying the feeding of cold water until the hot water has reached a preset working temperature.

18. A method for feeding washing water into a machine for washing such as a washing machine for laundry, dishwasher and the like, wherein the machine for washing comprises a drum for washing articles, a circuit for feeding washing water to said drum and valve means comprising a hollow valve body wherein a current of water flows, entering the valve body via at least one inlet of the valve, and at least one plug element for allowing and respectively preventing the outflow of water from a corresponding outlet of the valve, said valve being connected to at least one first temperature sensor device having a first and a second working state corresponding to a condition of opening and closure of an electrical connection and in that said sensor device has a preset trigger temperature which, when reached, causes the change from a state of closure to one of opening of the connection or vice versa for feeding cold water and hot water into said circuit of the current of water for said drum for washing articles and a timer for controlling operation of the machine, comprising the steps of sensing the temperature of the water fed into the circuit for feeding water to the washing drum and controlling the valve means for feeding a current of water into said drum for washing articles in such a way that if the temperature drops below a minimum preset temperature the entrance of cold water is blocked or the entrance of hot water is enabled, and if the temperature of the water is above the maximum preset temperature the entrance of the cold water is enabled or the entrance of hot water is blocked.

19. A method of taking detergent or the like in a machine for washing such as a washing machine for laundry, dishwasher and the like, wherein the machine for washing comprises a drum for washing articles, valve means comprising a hollow valve body wherein a current of water flows, entering the valve body via at least one inlet of the valve, and at least one plug element for allowing and respectively preventing the outflow of water from a corresponding outlet of the valve, said valve being connected to at least one first temperature sensor device having a first and a second working state corresponding to a condition of opening and closure of an electrical connection and in that said sensor device has a preset trigger temperature which, when reached, causes the change from a state of closure to one of opening of the connection or vice versa for feeding cold water and hot water into said circuit of the current of water for said drum for washing articles, at least one compartment for holding detergent wherein a flow of water is made to flow and which removes the detergent and transports it into the washing drum, valve means for feeding a detergent-removing flow into said compartment for the detergent and a suitable timer for controlling operation of the machine, comprising the step of feeding heated water to said detergent compartment only when said water has a temperature higher than a minimum preset temperature.

20. A method according to claim 19, wherein heated water is only fed to said detergent compartment when said water has a temperature lower than a maximum preset temperature.

21. Method according to claim 19, wherein said flow of heated water to the compartment for the detergent is diverted from the main flow towards the washing drum of the machine for washing.

22. A machine for washing such as a washing machine for laundry, dishwasher and the like, wherein the machine for washing comprises a drum for washing articles, a circuit for feeding washing water to said drum, and valve means for feeding cold water and hot water in said circuit of the current of water for said drum for washing articles and a timer for controlling operation of the machine, wherein it uses at least one valve according to claim 16.

23. A machine for washing such as a washing machine for laundry, dishwasher and the like, wherein the machine for washing comprises a drum for washing articles, a circuit for feeding washing water to said drum, valve means for feeding cold water and hot water into said circuit of the current of water for said drum for washing articles, at least one compartment for holding detergent wherein a flow of water is made to flow which removes the detergent and transports it into the washing drum, valve means for feeding a flow for detergent removal in said compartment for the detergent and a timer for controlling operation of the machine; wherein it uses at least one valve according to claim 1.

24. A machine for washing according to claim 22, wherein said first temperature sensor device of the valve has an electrical contact which can be opened and closed and which is included in the electrical circuit for actuating a feed valve between the control timer of the machine and said valve.

25. A machine for washing according to claim 22, wherein said first temperature sensor device of the valve is connected to the control timer of the machine to provide it with a signal of reaching of the preset working temperature of the sensor device.

26. A machine for washing according to claim 22, wherein said first and said second temperature sensor devices of the valve are both connected to the control timer of the machine to provide it with a signal that one or the other preset working temperatures of the sensing element has been reached.

* * * * *